US008720246B2

(12) United States Patent
Gritti et al.

(10) Patent No.: US 8,720,246 B2
(45) Date of Patent: May 13, 2014

(54) METHOD FOR SHAPING A BARREL SPRING MADE OF METALLIC GLASS

(75) Inventors: Dominique Gritti, Cortaillod (CH); Thomas Gyger, Le Fuet (CH); Vincent Von Niederhausern, Courrendlin (CH)

(73) Assignee: Rolex S.A., Geneva (CH)

( * ) Notice: Subject to any disclaimer, the term of this patent is extended or adjusted under 35 U.S.C. 154(b) by 587 days.

(21) Appl. No.: 12/996,542

(22) PCT Filed: Jun. 9, 2009

(86) PCT No.: PCT/CH2009/000191

§ 371 (c)(1),
(2), (4) Date: Dec. 6, 2010

(87) PCT Pub. No.: WO2010/000081

PCT Pub. Date: Jan. 7, 2010

(65) Prior Publication Data

US 2011/0072873 A1 Mar. 31, 2011

(30) Foreign Application Priority Data

Jun. 10, 2008 (EP) ..... 08405153
Aug. 4, 2008 (EP) ..... 08405192

(51) Int. Cl.
*B21D 37/16* (2006.01)

(52) U.S. Cl.
USPC ..... 72/342.5; 72/146; 140/89

(58) Field of Classification Search
USPC ..... 72/66, 135, 146, 148, 342.1, 342.5, 72/342.6, 364; 140/89
See application file for complete search history.

(56) References Cited

U.S. PATENT DOCUMENTS

| | | | | |
|---|---|---|---|---|
| 3,187,416 | A | 6/1965 | Tuetey et al. | |
| 3,343,573 | A * | 9/1967 | Dillon | 140/89 |
| 3,624,883 | A | 12/1971 | Baehni | |
| 4,288,901 | A * | 9/1981 | Babcock | 29/407.07 |
| 5,301,742 | A | 4/1994 | Sato et al. | |
| 5,772,803 | A | 6/1998 | Peker et al. | |
| 6,371,195 | B1 | 4/2002 | Onuki et al. | |

(Continued)

FOREIGN PATENT DOCUMENTS

| | | |
|---|---|---|
| DE | 3136303 A1 | 4/1983 |
| EP | 0942337 A1 | 9/1999 |

(Continued)

OTHER PUBLICATIONS

International Search Report of PCT/CH2009/000191, mailing date Oct. 6, 2009.

(Continued)

*Primary Examiner* — Edward Tolan
(74) *Attorney, Agent, or Firm* — Westerman, Hattori, Daniels & Adrian, LLP

(57) ABSTRACT

The invention relates to a method for shaping a barrel spring made of a unitary ribbon of metallic glass that comprises calculating the theoretical shape to be given to said unitary ribbon of metallic glass so that each segment, once the spring is fitted in the barrel, is subjected to the maximum bending momentum, shaping said ribbon by imparting bends thereto characteristic of said free theoretical shape in order to take into account a potential reduction of the bends once the ribbon is released, relaxing the ribbon in order to set the shape thereof by heating the same, and cooling down said ribbon.

13 Claims, 1 Drawing Sheet

(56) References Cited

U.S. PATENT DOCUMENTS

| | | | | |
|---|---|---|---|---|
| 6,427,753 | B1 | 8/2002 | Inoue et al. | |
| 6,603,236 | B2 | 8/2003 | Nagasaka | |
| 6,622,540 | B2 * | 9/2003 | Jones et al. | 72/342.5 |
| 6,843,594 | B1 | 1/2005 | Moteki et al. | |
| 6,863,435 | B2 * | 3/2005 | Moteki et al. | 368/140 |
| 6,934,222 | B2 | 8/2005 | Fujimori | |
| 7,093,622 | B2 * | 8/2006 | Cram | 140/147 |
| 7,280,438 | B2 | 10/2007 | Fujisawa | |
| 7,955,387 | B2 * | 6/2011 | Richter | 623/11.11 |
| 8,348,496 | B2 * | 1/2013 | Gritti et al. | 368/140 |
| 2001/0030908 | A1 * | 10/2001 | Moteki et al. | 368/140 |
| 2006/0228917 | A1 * | 10/2006 | Hantschel et al. | 439/78 |
| 2007/0133355 | A1 * | 6/2007 | Hara et al. | 368/140 |
| 2009/0194205 | A1 | 8/2009 | Loffler et al. | |
| 2011/0072873 | A1 | 3/2011 | Gritti et al. | |
| 2012/0281510 | A1 | 11/2012 | Gyger et al. | |

FOREIGN PATENT DOCUMENTS

| | | | | |
|---|---|---|---|---|
| EP | 1385179 | A1 | 1/2004 | |
| FR | 1 533 876 | A | 7/1968 | |
| JP | 2-207935 | * | 8/1990 | B21F 35/00 |
| JP | 10-263739 | * | 10/1998 | B21J 5/06 |
| JP | 2002-249836 | A1 | 9/2002 | |
| WO | 2007/038882 | A1 | 4/2007 | |
| WO | 2011/069273 | A1 | 6/2011 | |

OTHER PUBLICATIONS

Pol'Dyaeva G.P. et al, "Elastic Characteristics and Microplastic Deformation of Iron-Base Amorphous Alloys", Metal Science and Heat Treatment USA, vol. 25, No. 9-10, Sep. 1983, pp. 653-654, XP002633344, ISSN: 0026-0673. Cited in co-pending U.S. Appl. Nos. 13/514,137 and 12/479,947.

Berner G.-A., "Dictionnaire Professionnel Illustréde I'Horlogerie", 1961, Chambre suisse de I'Horlogerie, La Chaux-de Fonds, XP002580071, pp. 780-781, paragraph [3484C]; Figure 3484C. Cited in co-pending U.S. Appl. Nos. 13/514,137 and 12/479,947.

Koba E. S. et al., "Effect of plastic deformation and high pressure working on the structure and microhardness of metallic glasses", Acta Metallurgica & Materialien, vol. 42, No. 4, Apr. 1, 1994, pp. 1383-1388. Cited in co-pending U.S. Appl. Nos. 13/514,137 and 12/479,947.

Lu J. et al, "Deformation behavior of the Zr41.2Ti13.8Cu12.5Ni10Be22.5 bulk metallic glass over a wide range of strain-rates and temperatures", Acta Materialia 51, pp. 3429-3443, 2003. Cited in co-pending U.S. Appl. Nos. 13/514,137 and 12/479,947.

Luborsky F. E. et al., "Potential of amorphous alloys for application in magnetic devices", J. Appl. Phys. vol. 49, No. 3, pp. 1769-1774 (Mar. 1978). Cited in co-pending U.S. Appl. No. 12/479,947.

Osterstock F. et al., "Fracture of Metallic Glass Ribbons at Room and Low Temperatures as a Function of the Degree of Relaxation", International Journal of Rapid Solidification, vol. 3, pp. 295-317 (1987). Cited in co-pending U.S. Appl. No. 12/479,947.

Liebermann, H.H. et al., "Rapidly Solidified Alloys", Marcel Dekker, Inc., New York, pp. 279-282, 397-402, 422-430 (1993). Cited in co-pending U.S. Appl. No. 12/479,947.

Feodorov, V.A. et al., "Evolution of mechanical characteristics of metallic glass Co—Fe—Cr—Si at annealing", in Eight International Workshop on Nondestructive Testing and Computer Simulations in Science and Engineering, Proc. of SPIE vol. 5831, SPIE, Bellingham, WA, pp. 181-185 (2005). Cited in co-pending U.S. Appl. No. 12/479,947.

"Alloy Information, NIVAFLEX(R) 45/5", Vacuumschmelze GmbH & Co, KG, Hanau, Germany, 2 pages (Jan. 2008). Cited in co-pending U.S. Appl. No. 12/479,947.

European Search Report of EP08405192, dated Mar. 12, 2009, priority application of co-pending U.S. Appl. No. 12/479,947.

Kumar et al., "Thermal embrittlement of Fe-based amorphous ribbons", J. Non-Crystalline Solids, 354, pp. 882-888 (2008). Cited in co-pending U.S. Appl. No. 12/479,947.

Inoue et al., "Preparation, mechanical strengths, and thermal stability of Ni—Si—B and Ni—P—B amorphous wires", Metallurgical Transactions, 18A, pp. 621-629 (1987). Cited in co-pending U.S. Appl. No. 12/479,947.

Morris, "Crystallization embrittlement of Ni—Si—B alloys", J. Materials Science, 20, pp. 331-340 (1985). Cited in co-pending U.S. Appl. No. 12/479,947.

Favre, "Various types of springs used in watchmaking", Bulletin SSC, 22, pp. 19-25 (1996), with partial English translation. Cited in co-pending U.S. Appl. No. 12/479,947.

* cited by examiner

METHOD FOR SHAPING A BARREL SPRING MADE OF METALLIC GLASS

The present invention relates to a process for shaping a mainspring, formed from a metallic glass material, for a mechanism driven by a drive spring, especially for a timepiece.

A watch has already been proposed, in EP 0 942 337, which comprises a drive spring made of an amorphous metal. In fact, only a strip formed from a laminate comprising ribbons having thicknesses ranging up to 50 μm made of amorphous metal that are joined together with an epoxy resin as described in the above document. As a variant, an assembly of strips, obtained by spot welding the two ends and the point of inflection of the free shape of the spring, has been proposed.

The major problem of such a strip is the high risk of the laminate delaminating during its shaping operation and following the repeated winding and unwinding operations to which such a spring is subjected. This risk is all the more acute since the resin ages poorly and loses its properties.

This solution does not guarantee the functionality and fatigue behavior of the spring. Furthermore, the modeling of the theoretical shape of the spring proposed does not take into account the behavior of a laminated material.

The reason for choosing to use several thin strips joined together is because of the difficulty of obtaining thicker metallic glass strips, although processes for manufacturing ribbons with a thickness ranging from around ten to around thirty microns by rapid quenching are known, these having been developed during the 1970s for amorphous ribbons used for their magnetic properties.

It is obvious that such a solution does not meet the torque, reliability and autonomy requirements that a mainspring must satisfy.

In conventional mainsprings made especially of the alloy Nivaflex®, the initial alloy strip is formed into a mainspring in two steps:

- the strip is wound on itself to form a tight spiral (elastic deformation) and then treated in a furnace to fix this shape. This heat treatment is also essential for the mechanical properties since it enables the yield strength of the material to be increased by modifying its crystalline structure (precipitation structural hardening); and
- the spiral spring is fatigued, therefore plastically deformed cold, in order to adopt its definitive shape. This also allows the stress level available to be increased.

The mechanical properties of the alloy and the final shape result from the combination of these two steps. It would not be possible to obtain the desired mechanical properties for the conventional alloys by a heat treatment alone.

The fixing of crystalline metal alloys involves a relatively long treatment time (several hours) at quite a high temperature in order to induce the desired modification of the crystalline structure.

In the case of metallic glasses, the mechanical properties of the material are intrinsically due to its amorphous structure and are obtained immediately after solidification, unlike the mechanical properties of conventional springs made of the alloy Nivaflex®, which are obtained by a series of heat treatments at various steps in their manufacturing process. Therefore, and unlike in the alloy Nivaflex®, a subsequent hardening by heat treatment is unnecessary.

Conventionally, only the fatiguing enables the spring to adopt an optimum shape, which allows maximum stressing of the strip over its entire length once the spring has been wound up. However, for a spring made of a metallic glass, the final optimum shape is fixed just by a single heat treatment, the high mechanical properties being used solely due to the amorphous structure. The mechanical properties of metallic glasses are not changed by the heat treatment or by the plastic deformation, since the mechanisms are completely different from those encountered in a crystalline material.

The object of the present invention is to remedy, at least partly, the abovementioned drawbacks.

For this purpose, the subject of the present invention is a process for shaping a mainspring formed from a monolithic ribbon made of a metallic glass, characterized in that:

- the theoretical free shape to be given to this monolithic ribbon made of a metallic glass, so that each segment, once the mainspring is fully wound in the barrel, i.e. subjected to the maximum bending moment, is calculated;
- this ribbon is shaped, giving it curvatures characteristic of this theoretical free shape, in order to take account of a reduction in the curvatures once the ribbon is freed;
- the ribbon is subjected to relaxation in order to fix its shape, by heating it; and
- this ribbon is cooled.

Advantageously, the theoretical free shape of the mainspring is obtained from the monolithic ribbon by placing it in an appropriate fitting tool. Advantageously, the shaped monolithic ribbon is fixed by subjecting it to heating in a range between the glass transition temperature −50 K and the crystallization temperature +50 K. Advantageously, the shaped ribbon is fixed by heating it and then cooling it over a time interval of less than 6 minutes. Advantageously, the ratio of the curvatures of said shaped ribbon before relaxation heating to the curvatures of the theoretical free shape lies between 100% and 140%, for example, typically 130%.

By producing a mainspring made of a monolithic ribbon of metallic glass it is possible to benefit from all the advantages of this class of material, in particular its ability to store a high density of elastic energy and to recover it with a remarkably constant torque. The maximum stress and Young's modulus values of these materials make it possible to increase the $\sigma^2/E$ ratio relative to conventional alloys, such as Nivaflex®.

The appended drawings illustrate, schematically and by way of example, one way of implementing the process for shaping a mainspring according to the invention:

Figure 1:
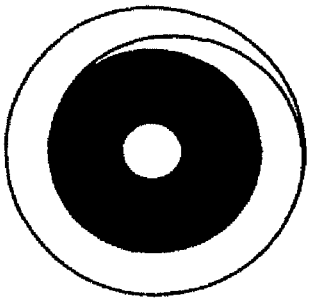
FIG. 1 is a plan view of the fully-wound mainspring in the barrel.

In the example explained below, the ribbons intended to form the mainsprings are produced by the technique of quenching the material on a wheel (or planar flow casting) which is a technique for producing metallic ribbons by rapid cooling. A jet of molten metal is projected onto a cold wheel rotating at high speed. The speed of the wheel, the width of the injection slot and the injection pressure are some of the parameters that will define the width and the thickness of the ribbon produced. Other ribbon production techniques may also be used, such as for example twin-roll casting.

In this example, the alloy used is $Ni_{53}Nb_{20}Zr_8Ti_{10}Co_6Cu_3$: 10 to 20 g of this alloy are placed in a delivery nozzle heated to between 1050 and 1150° C. The width of the nozzle slot is between 0.2 and 0.8 mm. The distance between the nozzle and the wheel is between 0.1 and 0.3 mm. The wheel on which the molten alloy is deposited is a wheel made of a copper alloy and is driven at a speed of 5 to 20 m/s. The pressure exerted to expel the molten alloy through the nozzle is between 10 and 50 kPa.

Only a good combination of these parameters allows ribbons having a thickness of greater than 50 μm, typically from >50 to 150 μm, and a length of more than one meter to be formed.

For a ribbon subjected to pure flexure, the maximum elastic moment is given by the following equation:

$L_n$:length of the curvilinear abscissa of the nth turn [mm]

$r_n$:radius of the nth turn in the fully-wound state [mm]

θ: angle traveled [rad]. In the case of one turn, θ=2π.

The shape of the mainspring in its free state is calculated by taking into account the various radii of curvature so that the spring is stressed to $\sigma_{max}$ over the entire length.

$$\frac{1}{r_n} - \frac{1}{R^n_{free}} = \frac{M_{max}}{El} = \frac{2\sigma_{max}}{e\mathrm{E}} \tag{4}$$

$R_{free}{}^n$ free radius of the nth turn in the free state [mm]

$M_{max}$: maximum moment [N./mm]

E: Young's modulus [N/mm$^2$]

I: moment of inertia [mm$^4$].

Therefore, to calculate the theoretical shape of the mainspring in the free state, just the following elements have to be calculated:

1. the radius of the nth turn in the fully-wound state is calculated from equation (2) with n=1, 2, etc.;
2. the length of the curvilinear abscissa of the nth turn is calculated from equation (3);
3. the radius of the nth turn in the free state is calculated from equation (4); and
4. finally, the angle of the segment of the nth turn is calculated from equation (3) but with $r_n$ being replaced with $_{tree}{}^n$ and by maintaining the segment length $L_n$ calculated in point 2.

Figure 3:
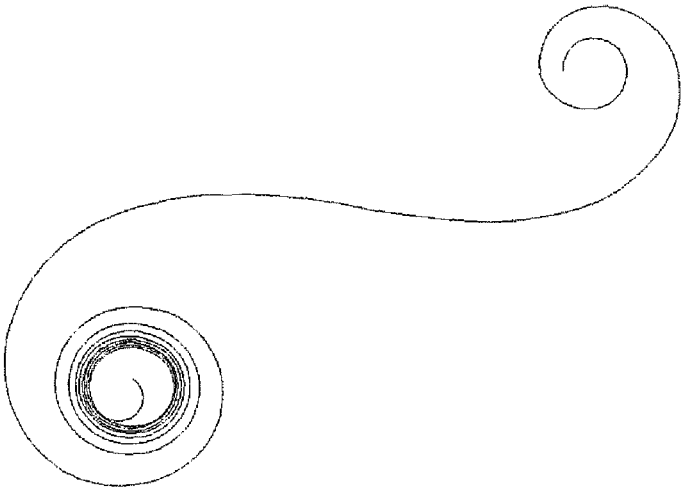
FIG. 3 is a plan view of the mainspring in its free state.

With these parameters, it is now possible to construct the mainspring in the free state so that each element of the spring is stressed to $\sigma_{max}$ (FIG. 3).

$$M_{max} = \frac{e^2\hbar}{\partial}\sigma_{max} \tag{1}$$

e: thickness of the ribbon [mm]

h: height of the ribbon [mm]

$\sigma_{max}$: maximum flexural stress [N/mm$^2$].

Figure 2:
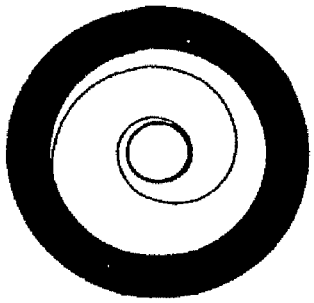
FIG. 2 is a plan view of the fully-unwound mainspring in the barrel.

The mainspring releases its energy when it passes from the fully-wound state to the fully-unwound state. The objective is to calculate the shape that the spring must have in its free state so that each section is subjected to the maximum bending moment in its fully-wound state. FIGS. 1 to 3 below describe the three configurations of the mainspring, namely the fully-wound, fully-unwound and free configurations respectively.

For the calculations, the spring in its fully-wound state (see FIG. 1) is considered as a spiral with the turns tightly pressed against one another.

In this case, any point on the curvilinear abscissa may be expressed as:

$$r_n = r_{post} + ne \tag{2}$$

$r_n$: radius of the nth turn in the fully-wound state [mm]

$r_{post}$: radius of the barrel post [mm]

n: number of winding turns e: thickness of the ribbon [mm].

In addition, the length of the curvilinear abscissa of each turn is given by:

$$L_n = r_n\theta \tag{3}$$

The metallic glass ribbon is obtained by rapidly solidifying the molten metal on a wheel made of copper or an alloy having a high thermal conductivity and rotating at high speed. A minimum critical cooling rate is required to vitrify the molten metal. If the cooling is too slow, the metal solidifies by crystallization and loses its mechanical properties. For a given thickness, it is important to ensure the maximum cooling rate. The higher this cooling rate, the less time the atoms will have to relax and the higher the free volume concentration will be. The ductility of the ribbon is therefore improved.

The plastic deformation of metallic glasses, below about 0.7×the glass transition temperature $T_g$ [K], takes place heterogeneously via the initiation and then the propagation of slip bands. The free volumes act as sites for nucleating the slip bands, and the larger the number thereof the less the deformation is localized and the higher the strain before fracture.

The planar flow casting step is therefore of paramount importance as regards the mechanical and thermodynamic properties of the ribbon.

Between $T_g$ (glass transition temperature) −100 K and $T_g$, the viscosity decreases strongly with temperature, by about an order of magnitude with a 10 K temperature rise. The viscosity at $T_g$ is generally equal to $10^{12}$ Pa.s independently of the alloy in question. It is therefore possible to model the viscous body, in this case the ribbon, so as to give it its desired shape and then to cool it to lastingly freeze the shape.

In the region of $T_g$ thermal activation allows the free volumes and atoms within the material to diffuse. Locally, the atoms will form denser domains, close to a crystalline structure, at the expense of the free volumes, which will be annihilated. This phenomenon is called relaxation. The reduction in free volume is accompanied by an increase in the Young's modulus and a reduction in subsequent ductility.

At higher temperatures (above $T_g$), the relaxation phenomenon may be likened to annealing. By thermal agitation, the relaxation is accelerated and causes drastic embrittlement of the glass by annihilating the free volume. If the treatment time is too long, the amorphous material will crystallize and thus lose its exceptional properties.

Hot forming therefore entails a balance between relaxation sufficient to retain the desired shape and as small as possible a reduction in ductility.

To achieve this, the ribbon must be heated and cooled as rapidly as possible and must be kept at the desired temperature for a well-controlled time.

The alloy used, $Ni_{53}Nb_{20}Zr_8Ti_{10}Co_6Cu_3$, was selected for its excellent compromise between mechanical strength (3 GPa) and its ability to vitrify (3 mm critical diameter and ΔT (=$T_g$−$T_x$) equal to 50° C., T. denoting the crystallization temperature). Its elastic modulus is 130 GPa, measured in tension and bending.

Mechanical properties:

maximum strength $\sigma_{max}$=3000 MPa elastic strain $\epsilon_{max}$=0.02 elastic modulus E=130 GPa

Thermodynamic properties:

glass transition temperature $T_g$=593° C.

crystallization temperature $T_x$=624° C.

melting point $T_m$=992° C.

The ribbons produced by the PFC (planar flow casting) technique have a width of several millimeters and a thickness of between 40 and 150 μm. Ribbons were machined, by the technique of wire spark erosion, to the width and length typical of a mainspring. The sides were ground, after which the operation of shaping the spring was carried out, on the basis of the theoretical shape as calculated above.

The shaping process uses a fitting tool of the type of those generally used, onto which the spring is wound so as to give it its free shape, determined by the theoretical shape as calculated above, taking into account the variation between the shape imposed by the fitting tool and the free shape actually obtained. Specifically, it has been found that the curvatures (defined as the inverse of the radii of curvature) of the spring in the free state after the shaping operation were reduced relative to the curvatures of the shape of the fitting tool. The curvatures of the fitting tool must therefore be increased accordingly, so that the free shape obtained corresponds to the theoretical shape. Furthermore, the ratio of the curvatures of the shaped ribbon before relaxation heating to the curvatures of the theoretical free shape depends on the heating parameters, the alloy and its initial state of relaxation, and lies between 100% and 140%, typically at 130% under the conditions used below.

The spring in its fitting tool is then placed in a furnace heated to about $T_g$ (590° C.) for a time ranging from 3 to 5 minutes, depending on the fitting tool used.

Other heating methods may be used, such as Joule (resistive) heating or heating with a jet of hot inert gas for example.

Riveted onto the external end of the spring, once it has been shaped in this way, is a sliding flange for a self-winding watch mainspring made of Nivaflex® alloy, in order for winding/unwinding tests to be carried out. The sliding flange is necessary in order for such a spring to fulfill its function. However, the method of joining said flange to the strip and the material of the flange may vary.

Figure 4:
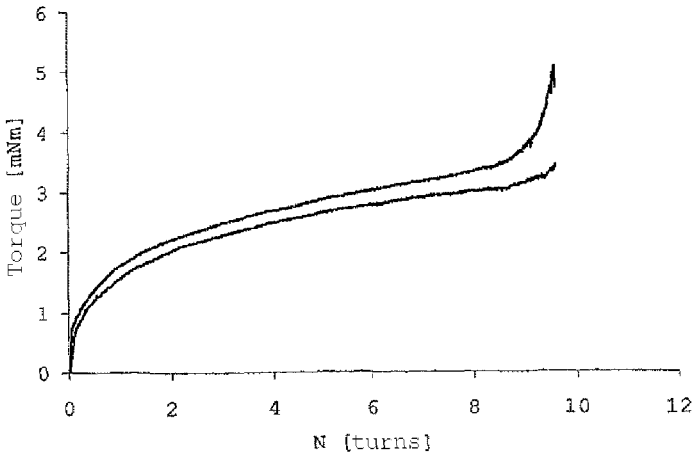
FIG. 4 is a winding-unwinding graph for a mainspring made of a metallic glass.

FIG. 4 shows the variation in torque as a function of the number of turns obtained with the spring calculated and shaped according to the method described in this document. This winding/unwinding curve is very characteristic of the behavior of a mainspring. In addition, the torque, the number of development turns and the overall efficiency, given the dimensions of the ribbon, are completely satisfactory.

The invention claimed is:

1. A process for shaping a mainspring which is a single monolithic ribbon made of a metallic glass, comprising:

calculating a theoretical free shape to be given to the single monolithic metallic glass ribbon made of a metallic glass, so that each segment, once the mainspring is fully wound in a barrel, is subjected to a maximum bending moment;

shaping the single monolithic metallic glass ribbon, giving it curvatures characteristic of the theoretical free shape, in order to take account of a reduction in the curvatures once the ribbon is freed;

subjecting the single monolithic metallic glass ribbon to relaxation in order to fix its shape, by heating it; and cooling the single monolithic metallic glass ribbon, so as to obtain the single monolithic metallic glass ribbon having curvatures in a free shape of the ribbon.

2. The process as claimed in claim 1, in which the theoretical free shape of the mainspring is obtained from the monolithic ribbon by placing it in an appropriate fitting tool.

3. The process as claimed claim 1, in which the shaped monolithic ribbon is fixed by subjecting it to heating in a range between a glass transition temperature of the metallic glass −50 K and a crystallization temperature of the metallic glass +50 K.

4. The process as claimed in claim 1, in which the shaped ribbon is fixed by heating it and then cooling it over a time interval of less than 6 minutes.

5. The process as claimed in claim 1, in which a ratio of the curvatures of said shaped ribbon before relaxation heating to the curvatures of the theoretical free shape lies between 100% and 140%.

6. The process as claimed in claim 5, in which a ratio of the curvatures of said shaped ribbon before relaxation heating to the curvatures of the theoretical free shape is typically 130%.

7. The process as claimed claim 2, in which the shaped monolithic ribbon is fixed by subjecting it to heating in a range between a glass transition temperature of the metallic glass −50 K and a crystallization temperature of the metallic glass +50 K.

8. The process as claimed in claim 2, in which the shaped ribbon is fixed by heating it and then cooling it over a time interval of less than 6 minutes.

9. The process as claimed in claim 3, in which the shaped ribbon is fixed by heating it and then cooling it over a time interval of less than 6 minutes.

10. The process as claimed in claim 7, in which the shaped ribbon is fixed by heating it and then cooling it over a time interval of less than 6 minutes.

11. The process as claimed in claim 1, in which the single monolithic metallic glass ribbon has curvatures in a spiral shape in a free state of the ribbon.

12. The process as claimed in claim 2, in which the single monolithic metallic glass ribbon has curvatures in a spiral shape in a free state of the ribbon.

13. The process as claimed in claim 3, in which the single monolithic metallic glass ribbon has curvatures in a spiral shape in a free state of the ribbon.

* * * * *